United States Patent [19]

Imazeki et al.

[11] 4,321,525

[45] Mar. 23, 1982

[54] REFERENCE VOLTAGE GENERATING CIRCUIT IN A DC POWER SUPPLY

[75] Inventors: Ryoji Imazeki; Masayuki Hattori, both of Hachioji; Shigeo Nakamura, Hino, all of Japan

[73] Assignee: Fujitsu Fanuc Limited, Tokyo, Japan

[21] Appl. No.: 109,118

[22] Filed: Jan. 2, 1980

[30] Foreign Application Priority Data

Oct. 11, 1978 [JP] Japan ..... 53-124957

[51] Int. Cl.[3] ..... G05F 1/64

[52] U.S. Cl. ..... 323/281; 323/349

[58] Field of Search ..... 307/356, 360, 361; 323/22 T, 8, 94 R, 22 Z, 273, 281, 349

[56] References Cited

U.S. PATENT DOCUMENTS

| | | | |
|---|---|---|---|
| 3,370,222 | 2/1968 | Haagen-Smit et al. | 323/349 |
| 3,406,331 | 10/1968 | Rose | 323/22 T |
| 3,423,689 | 1/1969 | Miller et al. | 323/22 T |
| 3,435,328 | 3/1969 | Allen | 323/8 |
| 3,440,518 | 4/1969 | Cliffgard et al. | 323/349 |
| 3,448,372 | 6/1969 | Goff | 323/22 T |

OTHER PUBLICATIONS

Revista Telegrafica Electronica (Argentina), vol. 64, No. 757, pp. 20–24, Jan. 1976.

Electronics Applications Industrial (France), No. 239, p. 62, 6-15-77.

*Primary Examiner*—William H. Beha, Jr.

*Attorney, Agent, or Firm*—Staas & Halsey

[57] ABSTRACT

A reference voltage generating circuit in a DC power supply includes a differential amplifier for detecting a difference voltage between a reference voltage and the output voltage, and a voltage control circuit which is responsive to an output signal from the differential amplifier so as to control the DC power supply output voltage to limit the difference between the output voltage and the reference voltage to zero. More specifically, the reference voltage generating circuit includes a reference voltage source, a first variable resistor connected in parallel with the reference voltage source, a second variable resistor connected to the negative side of the reference voltage source, a third variable resistor connected to the positive side of the reference voltage source, and a switching circuit for connecting a movable contact piece of the first variable resistor to either the second or third variable resistors, or to neither of them. A predetermined voltage of a magnitude greater than, equal to or less than a rated value can be delivered as a reference voltage at the movable contact piece of the first variable resistor by selecting from a plurality of preadjusted voltage divider circuits using a single selection operation.

8 Claims, 8 Drawing Figures

PRIOR ART FIG. 1
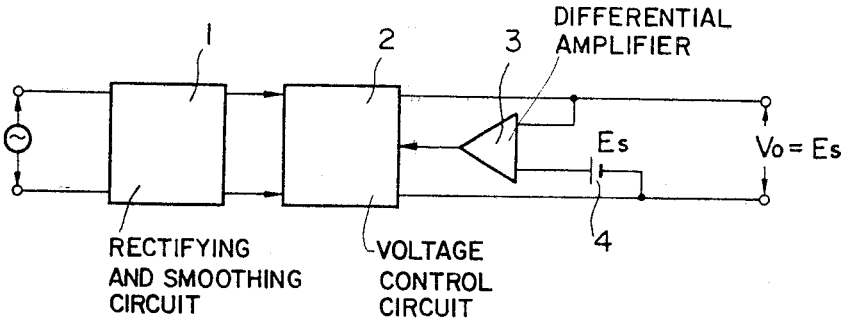
PRIOR ART FIG. 2
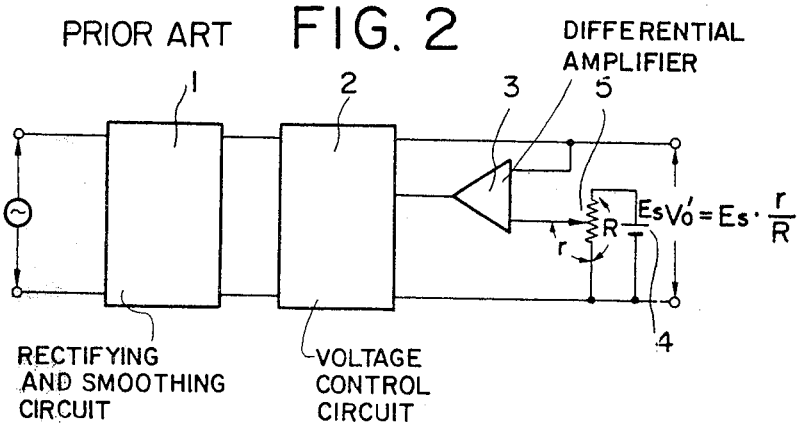
PRIOR ART FIG. 3
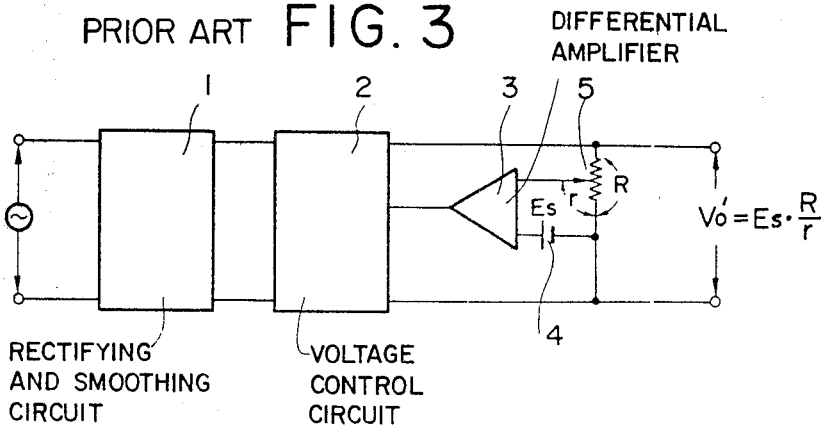

REFERENCE VOLTAGE GENERATING CIRCUIT IN A DC POWER SUPPLY

BACKGROUND OF THE INVENTION

1. Field of the Invention

This invention relates to a DC regulated power source apparatus, and more particularly to a DC regulated power source incorporated in an electronic device.

2. Description of the Prior

Electronic devices, such as communications equipment or sequence controllers and numerical control units for controlling machine tools, generally incorporate a DC regulated power source device which supplies their electronic components with a regulated DC voltage. These DC regulated power sources include a reference power source for generating a reference voltage, as well as an output voltage control element. The output voltage control element such as a differential amplifier constantly compares the output voltage against the reference voltage and functions to hold the output voltage constant at all times by restoring the output voltage to the reference voltage when the former attempts to rise, or by raising the output voltage up to the reference voltage when the former attempts to drop.

The DC regulated power source devices referred to above usually produce the reference voltage through use of a Zener diode. However, since Zener voltages can differ slightly even for Zener diodes of the same type or grade, using the voltage obtained from such diodes as a reference voltage results in irregularities among the devices that receive the output voltage from the DC regulated apparatus. It is therefore conventional practice to employ a Zener diode of a higher Zener voltage than the reference voltage, and to divide this high Zener voltage down to an accurate reference voltage by means of a potentiometer.

When a machine tool is inspected or subjected to maintenance after installation in a factory, or when an inspection is carried out during the course of manufacture, there are cases where an operating margin test is conducted by shifting the operating voltage of a numerical control unit or sequence controller in the plus or minus direction by a prescribed value with respect to a rated voltage. When varying the voltage in this fashion, it is conventional practice to rotate, by small increments, the potentiometer which is used to divide the Zener voltage, thereby shifting the output voltage toward a prescribed value while closely observing an output voltmeter.

On the other hand, a hardware operating check has been facilitated greatly by automating the checking procedure or by providing machine tools, or the electronic devices which they incorporate, with a self-diagnosing function. It would be very convenient if the operating margin check could be included with the other operating checks since this would permit a confirmation of the operating margin of the circuitry. However, since the output voltage has been required to be adjusted by the manual operation of a potentiometer as described above, it has not been possible to insert into a series of automated testing steps an additional test step for confirming the operating margin of the circuitry.

SUMMARY OF THE INVENTION

It is therefore an object of the present invention to provide a DC regulated power source apparatus for incorporation in a variety of electronic equipment, the output of which apparatus is finely adjusted to correct for discrepancies in the reference voltage of a reference power source, and which allows the output voltage to be shifted to a preset value by an operation command signal which does not require the intervention of an operator, or by a simple switching procedure performed by an operator.

It is another object of the present invention to provide a DC regulated power source apparatus whose output voltage can be finely adjusted in a continuous manner.

It is still another object of the present invention to provide a DC regulated power source apparatus whose output voltage, which has been adjusted to a prescribed value, can be shifted manually or automatically by a fixed amount.

It is a further object of the present invention to provide a DC regulated power source apparatus which, when the output voltage is shifted to a fixed voltage that is higher than a prescribed value, minimizes any error in the output voltage even if a reference voltage fluctuates.

Other and further objects, features and advantages of the invention will appear more fully from the following description.

BRIEF DESCRIPTION OF THE DRAWINGS

The present invention will be more clearly understood by referring to the following detailed description when considered in conjunction with the accompanying drawings wherein:

FIG. 1 is a block diagram of a conventional DC regulated power source apparatus;

FIGS. 2 and 3 are block diagrams of conventional DC regulated power source apparatuses whose output voltages are capable of being varied;

DETAILED DESCRIPTION OF THE PREFERRED EMBODIMENTS

Figure 4:
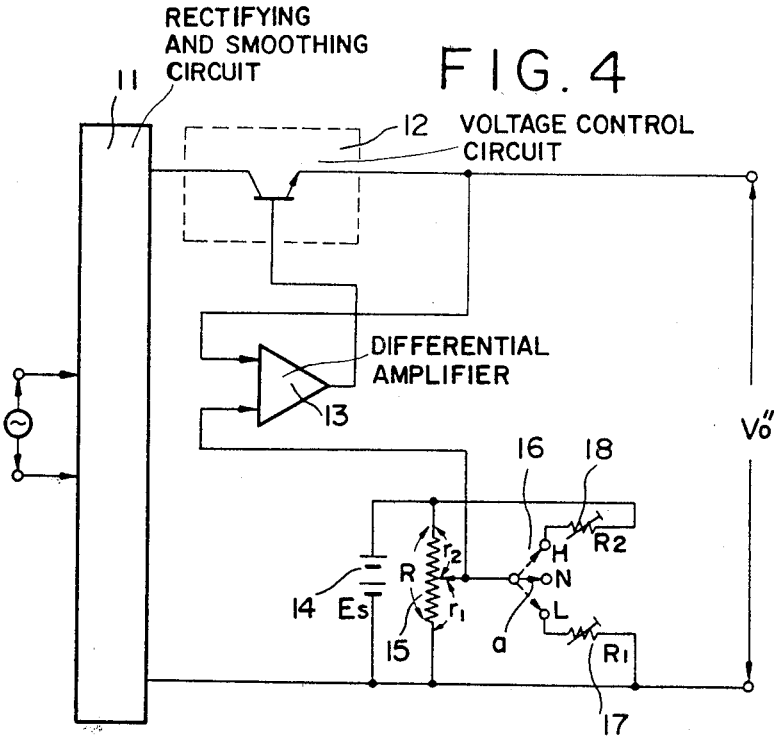
FIG. 4 is a circuit diagram illustrating a first embodiment of the present invention.

Illustrated in FIG. 1 is a functional block diagram of a typical DC regulated power source apparatus which has long been known in the art. The apparatus includes a rectifying and smoothing circuit 1, a voltage control circuit 2, a differential amplifier 3, and a reference voltage power source 4 which supplies a reference voltage $E_S$. The differential amplifier 3 detects a difference in voltage between the reference voltage $E_S$ and an output voltage $V_O$, and responds by controlling the voltage control circuit 2 in such a manner that the difference in voltage is limited to zero, thereby equalizing the output voltage $V_O$ and reference voltage $E_S$ at all times. A Zener diode is employed in the reference voltage power source 4. However, though Zener diodes may be of an identical type or grade, it is common for such diodes to provide Zener voltages which differ from one another to an extremely small degree. A prescribed voltage therefore cannot be obtained with the apparatus of FIG. 1 as long as it is not possible to acquire Zener diodes which can provide Zener voltages which are identical to the reference voltage $E_S$. It is for this reason that the systems shown in FIGS. 2 and 3 are adopted in the prior art. In FIG. 2, for example, a rheostat 5 is employed to divide the reference voltage $E_S$, with the output voltage $E_O$ being adjusted to a desired value within the range of the reference voltage $E_S$. In FIG. 3, the output voltage $V_O$ is adjusted to a prescribed voltage through multiplying the reference voltage $E_S$ by the ratio of the resistance value R of rheostat 5 to the divided resistance r.

The present invention, as will be described hereafter in connection with embodiments thereof, is based upon the DC regulated power source apparatus of the types shown in FIGS. 1 through 3, in which a differential amplifier is used to compare an output voltage against a reference voltage, with a voltage control circuit being controlled in response to the output of the differential amplifier to hold the output voltage of the apparatus at a prescribed value.

FIG. 4 is a circuit diagram illustrating an embodiment of the present invention. The arrangement includes a rectifying and smoothing circuit 11, a voltage control circuit 12, a differential amplifier 13, a reference power source 14, a variable resistor 15 having total resistance R, a three-point type selector switch switch 16, and rheostats 17, 18 having respective resistance values of $R_1$ and $R_2$.

The arrangement of FIG. 4 operates as follows. Movable contact a of switch 16 ordinarily is switched to neutral pole N. The output voltage $V_o''$ is decided by the voltage dividing ratio $\alpha$ ($\alpha = r_1/R$) determined by variable resistor 15, and the reference voltage $E_s$. In other words, $V_o'' = E_s\alpha$. When a difference between the output voltage $V_o''$ and a reference value is observed because of a variance in the Zener voltage of the Zener diode that constructs the reference voltage source 14, the output voltage $V_o''$ is set to the reference value as in the prior art by adjusting the rheostat 15 to change the dividing ratio $\alpha$. The reference voltage $E_s$ of the reference voltage source 14 is preset to a value which is higher than the operating voltage of the electronic circuitry, such as a value which is twice the operating voltage.

If the movable contact a of switch 16 is now switched from the neutral position N to a low voltage position L instead of changing the dividing ratio $\alpha$ by manipulating the rheostat 15, the corresponding variation in the dividing ratio $\alpha$ will obey the following relationship, $$\alpha_L = \frac{r_1//R_1}{r_1//R_1 + r_2} < \alpha, \text{ where } r_1//R_1 = \frac{1}{1/r_1 + 1/R_1}.$$

The above equation shows that the output voltage $V_o''$ drops to a fixed value by varying the dividing ratio $\alpha$ until it attains the value $\alpha_L$. The fixed value to which the output voltage $V_o''$ drops can be varied by changing the value of $R_1$ through adjustment of the rheostat 17. Restoring the output voltage $V_o''$ to the original value can be accomplished merely by switching the movable contact a back to the neutral position N.

If the movable contact a of switch 16 is next switched from the neutral position N to a high voltage position H, the variation in the dividing ratio $\alpha$ now will obey the following relationship, $$\alpha_H = \frac{r_1}{r_1 + r_2//R_2} > \alpha, \text{ where } r_2//R_2 = \frac{1}{1/r_2 + 1/R_2}$$

The above equation shows that the output voltage $V_o''$ rises to a fixed value by varying the dividing ratio until it attains the value $\alpha_H$. The fixed value to which the output voltage $V_o''$ rises can be varied by changing the value of $R_2$ through adjustment of the rheostat 18. As before, the output voltage $V_o''$ can be restored to the original value merely by switching the movable contact a back to the neutral position N. The movable contact a can be switched over manually or automatically through the use of suitable drive means. One example in which the latter can be accomplished is by means of an electromagnetic switch whose contact is adapted to be switched over by an electromagnetic force.

Another embodiment will now be described in which output voltage is shifted to a fixed value higher or lower than a reference voltage, wherein the shift is accomplished automatically, by a command signal, or manually. Such an embodiment is shown in FIG. 5 in which portions that bear the same reference numerals as those in FIG. 4 are similar thereto and need not be described again.

Figure 5:
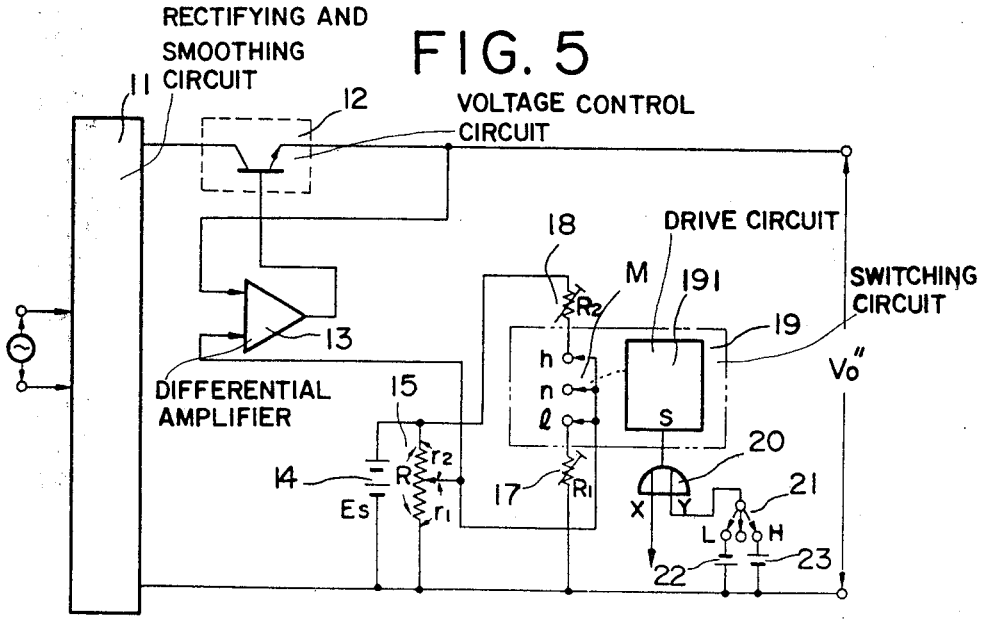
FIG. 5 is a circuit diagram illustrating a second embodiment of the present invention.

Turning now to FIG. 5, a switching circuit is designated generally at 19, the circuit including stationary contacts h, n, l, a movable contact M, and a drive circuit 191 for actuating the movable contact M. Drive circuit 191 has a signal input terminal S. Movable contact M is switched to stationary contact n when signal input terminal S is at zero potential, to stationary contact h when input terminal S is at a positive potential (+5 volts), and to stationary contact l when input terminal S is at a negative potential (−5 volts). Rheostat 17 is connected to stationary contact l, and semi-fixed variable resistor 18 to stationary contact h. An OR gate 20 has its output side connected to the signal input terminal S of drive circuit 191, and has one input terminal X connected to a driving signal generator (not shown) and its other input terminal is connected to the variable contact of three-point switch 21. Sources of +5 and −5 volt signals are shown at 23 and 22, respectively.

When automatically shifting the output voltage by a fixed value to a level which is lower than a prescribed value, a −5 volt signal from the driving signal generator is applied to the input terminal X of OR gate 20, whereupon the signal is delivered to drive circuit 191 through the OR gate. Drive circuit 191 responds by switching the movable contact M to the stationary contact l, whereby the output voltage is shifted downward by a fixed value as in the foregoing embodiment. When automatically shifting the output voltage by a fixed value to a level which is higher than a prescribed value, a +5 volt signal from the driving signal generator is applied to the input terminal X of OR gate 20, whereupon the signal is delivered to drive circuit 191 through the OR gate. Drive circuit 191 now responds by switching the movable contact M to the stationary contact h, whereby the output voltage is shifted upward by a fixed value as in the foregoing embodiment. On the other hand, no signals are delivered to drive circuit 191 from the driving signal generator when the output voltage is to be maintained at the prescribed value. On such occasions the movable contact M is switched to the stationary contact n. If it is now desired to shift the output voltage upward or downward by a fixed value through a manual instead of the automatic method, the three-point switch 21 need only be manipulated by hand to apply the +5 volt signal or −5 volt signal to drive circuit 119.

Figure 6:
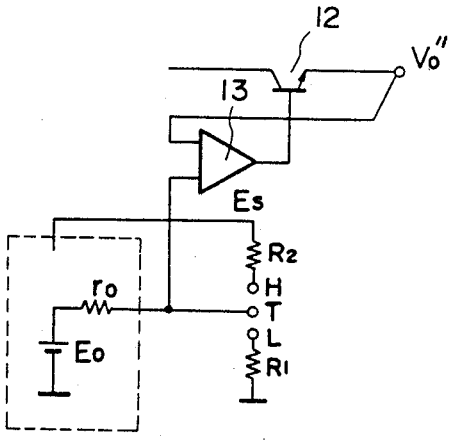
FIG. 6 is a simplified circuit diagram of the second embodiment shown in FIG. 5.

In each of the foregoing embodiments, the range over which the output voltage is shifted from the reference value, that is, upward or downward from the reference value by the fixed value, is decided by the value of the reference voltage $E_s$, the value of the resistors, $r_1$, $r_2$, and the value of resistor $R_1$ or $R_2$. FIG. 6 shows a simplification of the circuitry of the two foregoing embodiments in order to simplify the description of the invention. It should first be noted that $$E_o = \frac{r_1}{r_1 + r_2} E_s = V_o'', \text{ and } r_o = r_1//r_2 = f(E_s, V_o'', R),$$

where $$r_1//r_2 = \frac{1}{1/r_1 + 1/r_2}.$$

The range$=\Delta V_{oL}''+\Delta V_{oH}''$ over which the output voltage is varied in the circuit of FIG. 6 is given by the following:

$$\Delta V_{oL}'' = E_o \frac{r_o}{r_o + R_1}, \quad (1)$$

where $\Delta V_{oL}''$ represents the downward change when the output voltage is lowered by a fixed value from the prescribed value, and $$\Delta V_{oH}'' = (E_s - E_o) \frac{r_o}{r_o + R_2}, \quad (2)$$

where $\Delta V''_{oL}$ represents the upward change when the output voltage is raised by a fixed value from the prescribed value.

From the above it can be understood that, in the two foregoing embodiments, the closer the reference voltage $E_s$ is to $E_o$, the more $\Delta V''_{oH}$ is influenced by fluctuation in the reference voltage $E_s$, and hence, the more $\Delta V''_{oH}$ itself fluctuates. Accordingly, when switch 16 is changed over to alter the value of the resistance that loads the reference voltage source, the current flowing through the Zener diode undergoes a large change. If the Zener voltage experiences even a small variation, this is accompanied by a fluctuation in the output voltage, the value of which will therefore differ from the design voltage. Hence, an embodiment which will be described next is adapted to enhance the precision at which the output voltage is raised by a fixed value from the prescribed value.

Figure 7:
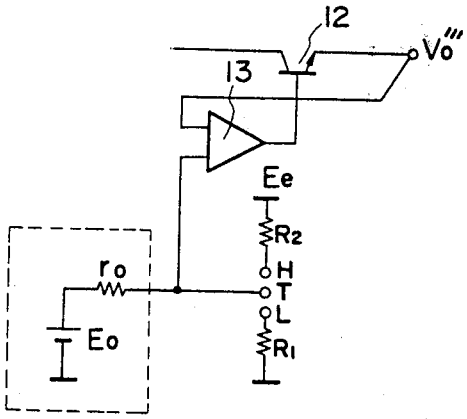
FIG. 7 is a simplified circuit diagram of a third embodiment of the present invention.

In this third embodiment as illustrated by the circuit diagram of FIG. 7, $E_e$ is a separate power source of a higher voltage than $E_o$, and is suitably regulated by a Zener diode or the like. The range $V'''_{oH}$ over which the output voltage is varied when terminals H and T are interconnected is given by the following equation, $$\Delta V_{oH}''' = (E_e - E_o) \frac{r_o}{r_o + R_2}.$$

Figure 8:
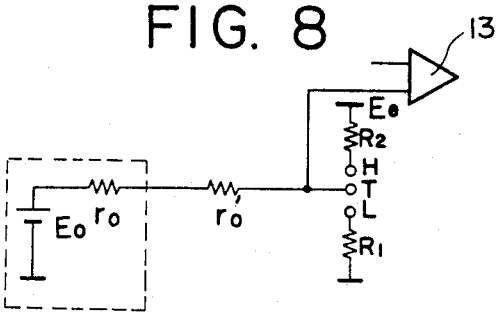
FIG. 8 is a simplified circuit diagram of a fourth embodiment of the present invention.

If $E_e$ is suitably stabilized to a greater extent than $E_o$, then the only fluctuation in $\Delta V'''_{oH}$ will be due to $r_o$ (where $r_o$ may also be considered to be a function of $E_s$, $V''_o$, and R). This fluctuation due to $r_o$ can be substantially suppressed by adopting the circuit shown in FIG. 8, wherein the equivalent circuit shows a resistor $r_o'$ inserted in series with resistor $r_o$, where $r_o' > r_o$. Adopting this circuit affords a further improvement in precision. This arrangement also enhances the precision at which the output voltage is lowered when terminals T and L are interconnected.

As evident from the foregoing description, the present invention includes a first variable resistor output voltage for setting an output voltage to a prescribed value, thereby allowing a variance in reference voltage to be corrected. The invention further includes a switching means for temporarily shifting the prescribed output voltage, set by the first variable resistor, to a preset value, thereby allowing the output voltage to be shifted through a simple operation whenever maintenance and inspection are performed. This eliminates the troublesome adjustment procedure encountered in the prior art, wherein adjustment must be performed while a voltmeter is observed. Moreover, actuating the output voltage varying means by an externally applied signal allows a test step for confirming circuit operating margin to be inserted into a series of automated test steps. Further, when shifting the output voltage upward from a reference voltage by a constant value, two reference voltage sources may be used to provide a voltage difference which is divided down to a voltage that may then be employed as the reference voltage which is applied to a differential amplifier. The shifted voltage will therefore attain a value in conformance with the planned value.

What we claim is:

1. A reference voltage generating circuit in a DC power supply which generates an output voltage, comprising:

a reference voltage source for generating a reference voltage;

a first variable resistor connected in parallel with said reference voltage source at first and second nodes and having a movable contact piece which acts as a tap to provide a tapped reference voltage;

a differential amplifier, operatively connected to said movable contact piece, for detecting a difference voltage between the tapped reference voltage and the output voltage and for generating a differential output signal;

a voltage control circuit, operatively connected to said differential amplifier and responsive to the differential output signal from said differential amplifier, for controlling the output voltage so as to limit the difference between the tapped reference voltage and the output voltage to zero;

a second variable resistor having a first terminal connected to the negative side of said reference voltage source at said second node and having a second terminal;

a third variable resistor having a first terminal connected to the positive side of said reference voltage source at said first node and having a second terminal; and switching means for selectively connecting said movable contact piece of said first variable resistor to the second terminal of said second variable resistor, or to the second terminal of said third variable resistor, or to selectively disconnect said movable contact piece from said second variable resistor and said third variable resistor, so that the tapped reference voltage of said movable contact piece of said first variable resistor is a preset voltage having a magnitude greater than, equal to or less than a predetermined voltage.

2. A reference voltage generating circuit according to claim 1, wherein said first variable resistor has a first leg connected between said first node and said movable contact piece and a second leg connected between said second node and said movable contact piece, wherein said second variable resistor is independently adjustable so that when said switching means connects the second terminal of said second variable resistor to said movable contact piece, a first voltage divider circuit, including said second variable resistor and the first leg of said first variable resistor, is formed, wherein the preset voltage produced at said movable contact piece is a first predetermined and independently adjusted reference voltage, wherein said third variable resistor is independently adjustable so that when said switching means connects the second terminal of said third variable resistor to said movable contact piece, a second voltage divider circuit, including said third variable resistor and the second leg of said first variable resistor, is formed, wherein the preset voltage produced at said movable contact piece is a second predetermined and independently adjusted reference voltage, whereby said switching means provides one of said predetermined voltage, said first predetermined and independently adjusted reference voltage, and said second predetermined and independently adjusted reference voltage as said tapped reference voltage.

3. A reference voltage generating circuit according to claim 1 or 2, wherein said switching means comprises:

a movable switch contact having a first end connected to said movable contact piece of said first variable resistor and having a second end movable to one of first, second, and third positions, wherein in said first position the second end of said movable contact piece is connected to the second terminal of said second variable resistor, wherein in said second position the second end of said movable contact piece is connected to the second terminal of said second variable resistor and wherein in said third position the second end of said movable contact piece is connected to provide the predetermined voltage; and a drive circuit, operatively connected to the second end of said movable switch contact, for moving the second end of said movable switch contact to one of said first, second, and third positions in dependence upon an externally applied drive signal.

4. A reference voltage generating circuit according to claim 1 or 2, wherein said second and third variable resistors comprise rheostats for finely adjusting the tapped reference voltage.

5. A reference voltage generating circuit according to claim 1 or 2, wherein said reference voltage source comprises first and second reference voltage sources, wherein the voltage difference between said first and second reference voltage sources is divided to produce the tapped reference voltage.

6. A reference voltage generating circuit according to claim 1 or 2, further comprising means for increasing the stability of the tapped reference voltage, including a resistor connected in series with said movable contact piece.

7. A reference voltage generating circuit according to claim 3, wherein said switching means includes means for operating said switching means in one of a manual and automatic mode.

8. A reference voltage generating circuit according to claim 5, further comprising means for increasing the stability of the tapped reference voltage, including a resistor connected in series to said movable contact piece.

* * * * *

UNITED STATES PATENT AND TRADEMARK OFFICE

CERTIFICATE OF CORRECTION

PATENT NO. : 4,321,525

DATED : March 23, 1982

INVENTOR(S) : Ryoji Imazeki et al.

It is certified that error appears in the above-identified patent and that said Letters Patent are hereby corrected as shown below:

Column 1, line 12, after "Prior" insert --Art--.
Column 3, line 11, "$E_o$" should be --Vo'--;
line 13, "$V_o$" should be --Vo'--;
line 30, delete "switch" (first occurrence).
Column 5, line 26, "range =" should be --range ΔVo =--.
Column 6, line 13, delete "output";
line 14, delete "voltage".

Signed and Sealed this

*Fourteenth* Day of *September 1982*

[SEAL]

*Attest:*

GERALD J. MOSSINGHOFF

*Attesting Officer*

*Commissioner of Patents and Trademarks*